US007151550B2

(12) United States Patent
Lau et al.

(10) Patent No.: US 7,151,550 B2
(45) Date of Patent: Dec. 19, 2006

(54) OLED DRIVER CIRCUIT WITH SELECTABLE LCD CONTROLLER INTERFACE AND DRIVE STRENGTH

(75) Inventors: Yuen Pat Lau, Hong Kong (HK); Wai-Yan Stephen Lai, Hong Kong (HK); Yiu Sang Lei, Hong Kong (HK); Chung Yee Ng, Hong Kong (HK); Jimmy Chiu, Hong Kong (HK)

(73) Assignee: Solomon Systech Limited, New Territories (HK)

( * ) Notice: Subject to any disclaimer, the term of this patent is extended or adjusted under 35 U.S.C. 154(b) by 584 days.

(21) Appl. No.: 10/698,442

(22) Filed: Nov. 3, 2003

(65) Prior Publication Data

US 2005/0093783 A1 May 5, 2005

(51) Int. Cl.
*G09G 5/02* (2006.01)

(52) U.S. Cl. ..... 345/698; 345/3.1

(58) Field of Classification Search ..... 345/698, 345/699, 3.1–3.4, 102
See application file for complete search history.

(56) References Cited

U.S. PATENT DOCUMENTS 6,680,802 B1 * 1/2004 Ichikawa et al. ..... 359/630
7,042,516 B1 * 5/2006 Moriya et al. ..... 348/553
2002/0113907 A1 * 8/2002 Endo et al. ..... 348/730
2002/0149545 A1 * 10/2002 Hanayama et al. ..... 345/7

* cited by examiner

*Primary Examiner*—Richard Osorio
(74) *Attorney, Agent, or Firm*—Finnegan, Henderson, Farabow, Garrett & Dunner, L.L.P.

(57) ABSTRACT

The present invention provides a display system comprising a liquid crystal display (LCD) controller and an organic light emitting diode (OLED) driver circuit. The LCD controller can be a mono super twisted nematic (STN) and gray scale and color thin film transistor (TFT) controller. The LCD controller processes general format data and accordingly generates segment control signals and common control signals. The OLED driver circuit according to a general embodiment of the display system of the present invention comprises an OLED segment driver with a corresponding segment interface adopter processing the segment control signals from the LCD controller, and an OLED common driver with a corresponding common interface adopter processing the common control signals from the LCD controller. According to a further embodiment, the display system further comprises a drive strength selector controlling the drive strength in the OLED segment driver. The display system according to the present invention can also include a drive strength selector controlling the drive strength in the OLED common driver.

20 Claims, 3 Drawing Sheets

OLED DRIVER CIRCUIT WITH SELECTABLE LCD CONTROLLER INTERFACE AND DRIVE STRENGTH

DESCRIPTION OF THE INVENTION

Field of the Invention

The present invention generally relates to organic light emitting diode (OLED) technology and, more particularly, to an OLED driver circuit with selectable controller interfaces and selectable drive strengths in current driving the OLED driver circuit in conjunction with a liquid crystal display (LCD) controller.

BACKGROUND OF THE INVENTION

Display driver integrated circuitry (IC) for flat panel displays such as an LCD can be classified into 2 large categories. The first category is the integrated controller and driver IC with embedded display memory, full controller logic, and analog signal drivers. Such an IC can perform all the digital data processing as well as generate all the analog driving signals necessary to drive the display panel, and to display general format data sent. The embedded controller consists of hardware logic for processing the incoming digital data, and for generating graphics control signals and analog control signals. The embedded analog drivers, under the control of the embedded controller, provide both the common and segment analog driving signals to drive the matrix pixels in the display panel.

The second category is the so-called generic driver IC with no embedded display memory and little logic. Separate common driver and segment driver ICs are included for providing the analog driving signals to drive the matrix pixels in the display panel. These common driver and segment driver ICs function under the control of specialized timing interface signals from an external controller with customized application hardware and software. Because there is little controller logic included in these analog drivers, their functionalities depend on extensive control signal processing from the external controller. The external controller receives and processes the general format data to generate the control signals for the separate analog drivers.

A segment driver in the art typically includes two lines of latches to store gray scale and color data. A token signal is input to start reading the data. The token signal is shifted across the first line of latches to enable storing of the data for each segment in a sequential fashion. When all data are stored in the first line of latches, a latch enable is needed to copy all data to a second line of latches. Data value is the second line of latches determines the duration of the current driving period. A line is then displayed as the next line of data is being read. This will be repeatedly performed until the whole frame is displayed.

A common driver in the art needs a row clock from the segment driver. A token signal is input to activate a row. The token signal is shifted across a line of latches so as to activate each row sequentially, a process known as scanning. For a split screen, the token signal is input to two different rows.

Token signals need to be generated for segment and common drivers when LCD controllers are used to drive an organic light emitting diode ("OLED") drivers in the art. An OLED is an electronic device made by placing a series of organic thin films between two conductors. When electrical current is applied, a bright light is emitted. When used to produce displays, OLED technology produces self-luminous displays that do not require backlighting.

In addition to controller interface difficulties, LCD requires voltage driving in contrast to OLED, which requires current driving. The required level of drive currents is dependent on panel applications and may vary over a wide range. There is thus a general need in the art for an OLED driver device and method overcoming at least the aforementioned shortcomings in the art. A particular need exists in the art for a driver device and method overcoming disadvantages in LCD controller-OLED driver interface difficulties.

SUMMARY OF THE INVENTION

Accordingly, a preferred embodiment of the present invention is directed to a display system (and associated method) having a liquid crystal display (LCD) controller and an organic light emitting diode (OLED) driver circuit that obviate one or more of the problems due to limitations and disadvantages of the related art.

To achieve these and other advantages, and in accordance with the purpose of the invention as embodied and broadly described, there is provided a display system comprising an LCD controller that works with an OLED driver circuit. The LCD controller can be either a super twisted nematic (STN) or a thin film transistor (TFT) controller. The LCD controller processes general format data and accordingly generates segment control signals and common control signals. The OLED driver circuit according to a general embodiment of the display system of the present invention comprises an OLED segment driver with a corresponding segment interface adopter processing the segment control signals from the LCD controller, and an OLED common driver with a corresponding common interface adopter processing the common control signals from the LCD controller. According to a further embodiment, the display system further comprises a drive strength selector controlling the drive strength in the OLED segment driver. The display system according to the present invention can also include a drive strength selector controlling the drive strength in the OLED common driver.

By adding an interface adopter in the OLED segment and common drivers, the LCD controller according to the present invention can advantageously shift data into OLED segment driver directly. A particular advantage of the present invention includes no special or customized external interface components are required for driving OLED segment and common drivers. In addition, integrated controller and drive integrated circuitry (IC) with embedded display memory, full controller logic and analog signal drivers will not be necessary.

In another aspect, the segment interface adopter according to the present invention further comprises a logic controller, gated clock generator, data latch, and pulse width modulation (PWM) signal generator for drive strength control. In still another aspect, the common interface adopter according to the present invention further comprises a logic controller, row enable signal generator generating signals enabling rows in the pixel matrix of the display system, and a plurality of row drivers driving rows in the pixel matrix.

In a further aspect, the present invention provides an organic light emitting diode (OLED) driving method for a liquid crystal display (LCD) controller comprising the steps of processing general format data for display in the LCD controller, providing segment control signals and common control signals from the LCD controller, processing the segment control signals in a segment interface adopter, processing the common control signals in a common interface adopter, driving the segment control signals in an OLED segment driver, and driving the common control signals in an OLED common driver. The LCD controller can be either a super twisted nematic (STN) or a thin film transistor (TFT) controller.

One embodiment of the driving method according to the present invention further comprises the step of controlling drive strength in the OLED segment driver. Another embodiment of the driving method further comprises the step of controlling drive strength in the OLED common driver. The LCD controller can advantageously shift data into the OLED segment driver directly and transparently with respect to LCD controller.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawing, which is incorporated in and constitutes a part of this specification, illustrates several embodiments of the invention and together with the description, serves to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

Figure 1:
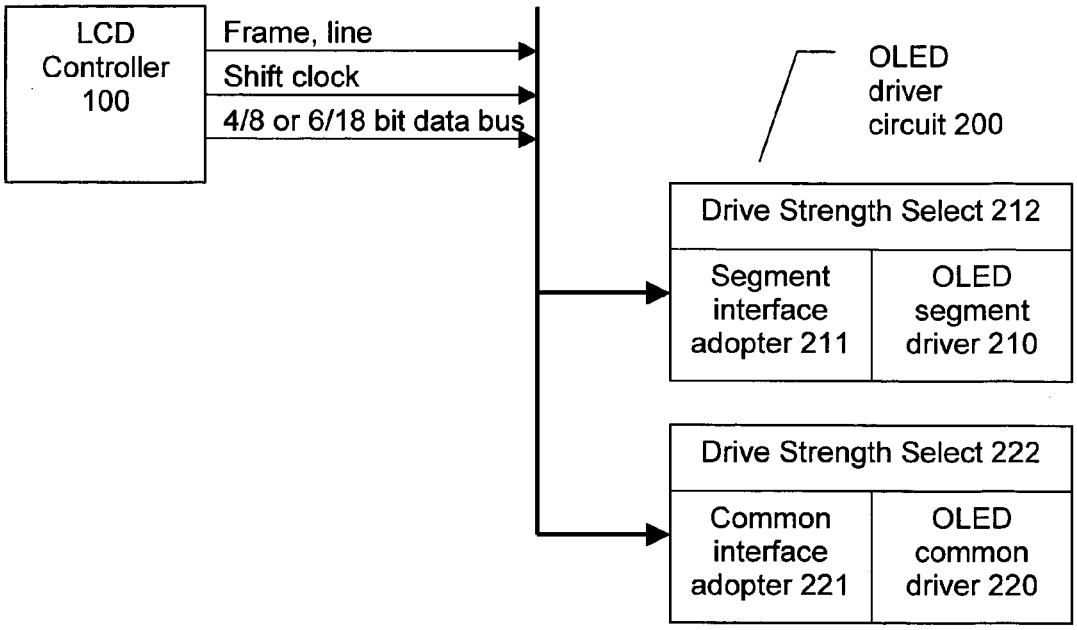
FIG. 1 is a block diagram of a display system having an LCD controller and OLED driver circuit according to a preferred embodiment of the present invention.

FIG. 1 is a block diagram of a display system having a liquid crystal display (LCD) controller 100 and organic light emitting diode (OLED) driver circuit 200 according to a preferred embodiment of the present invention. LCD controller 100 and OLED driver circuit 200 are not necessarily drawn to scale, in which the dimensions of various components may be arbitrarily increased or reduced. The LCD controller 100 can be either a super twisted nematic (STN) or a thin film transistor (TFT) controller.

LCD controller 100 processes general format data and accordingly generates segment control signals and common control signals. A 4/8 or 6/18 bit data bus couples LCD controller 100 and OLED driver circuit 200. Under the control of LCD controller 100, OLED driver circuit 200 provides both common and segment analog driving signals to drive the matrix pixels in the display system. A typical electroluminescence display comprises a matrix-addressed panel of electroluminescence elements located at the intersections of row and column address lines. An electroluminescence element generally comprises of two electrodes, an anode and a cathode; one electrode is connected to a row line while the other electrode is connected to a column line. An element conducts current and emits light when its anode and cathode are activated, by applying a positive voltage to the anode and a negative voltage to the cathode. The intensity of the emitted light is related to the magnitude of the current, which is dependent on the voltage applied across the electrodes. A driving system to drive an electroluminescence display generally activates the matrix-addressed elements one row or one column at a time in a fast sequential manner such that the sequentially emitting elements appear to the eye to be lighted at the same time in providing a properly perceived image display. In general, a common driver scans the rows, i.e. to address the rows one after the other in a sequential manner, and generally at the same time. A segment driver will drive the columns to activate or not activate the electroluminescence elements according to the image data.

OLED driver circuit 200 according to a general embodiment of the display system of the present invention comprises an OLED segment driver 210 with a corresponding segment interface adopter 211 processing the segment control signals from LCD controller 100, and an OLED common driver 220 with a corresponding common interface adopter 221 processing the common control signals from LCD controller 100. By adding an interface adopter in the OLED segment and common drivers, LCD controller 100 can advantageously shift data into OLED segment driver 210 directly. A particular advantage of the present invention lies in the fact that no special or customized external interface components are required for driving OLED segment driver 210 and common driver 220. In addition, integrated controller and drive integrated circuitry (IC) with embedded display memory, full controller logic and analog signal drivers will not be necessary.

According to a further embodiment, the display system further comprises a drive strength selector 212 controlling the drive strength in OLED segment driver 210. The display system according to the present invention can also include a drive strength selector 222 controlling the drive strength in OLED common driver 220. Using driver strength select control signals, latches in adjacent segments and/or rows in the pixel matrix can be enabled to activate both segments and rows at the same time. Source current is advantageously doubled in OLED segment driver 210, particularly for large panel displays and applications. Sink current can also be doubled accordingly, without requiring the use of a different common driver.

If OLED driver circuit 200 is implemented in a cascade arrangement, a master OLED segment driver will generate a token signal, which will be input to a slave OLED segment driver.

In a further aspect, the present invention provides an organic light emitting diode (OLED) driving method for a liquid crystal display (LCD) controller comprising the steps of processing general format data for display in the LCD controller, providing segment control signals and common control signals from the LCD controller, processing the segment control signals in a segment interface adopter, processing the common control signals in a common interface adopter, driving the segment control signals in an OLED segment driver, and driving the common control signals in an OLED common driver. The LCD controller can be either a super twisted nematic (STN) or a thin film transistor (TFT) controller.

One embodiment of the driving method according to the present invention further comprises the step of controlling drive strength in the OLED segment driver. Another embodiment of the driving method further comprises the step of controlling drive strength in the OLED common driver. The LCD controller can advantageously shift data into the OLED segment driver directly and transparently with respect to LCD controller.

Figure 2:
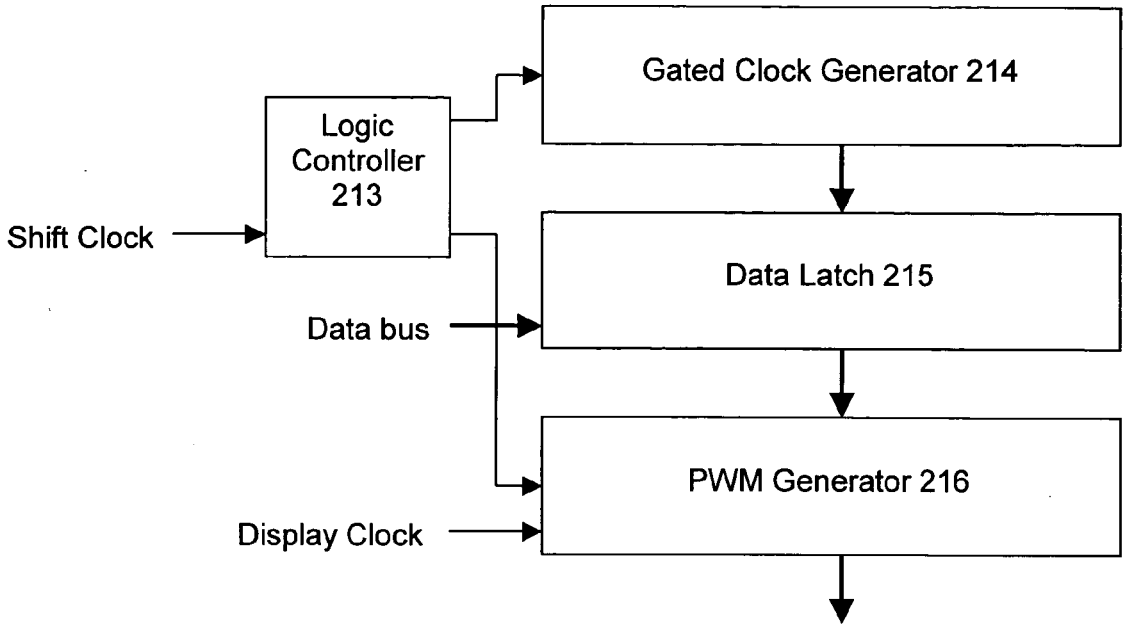
FIG. 2 is a block diagram of an interface adopter for the OLED segment driver according to one embodiment of the present invention.

FIG. 2 is a block diagram illustrating segment interface adopter 211 processing segment driving signals for OLED segment driver 210 according to one embodiment of the present invention. Referring to FIG. 2, segment interface adopter 211 comprises a logic controller 213, gated clock generator 214, data latch 215 and pulse width modulation (PWM) signal generator 216 for drive strength control. From LCD controller 100, data are shifted in and being latched when gated clock is present. When shift clock is present, a counter is used to locate data latch to store incoming data. Flexibility in storing data having different orders is advantageously increased. As token and latch enable signals are not input into segment interface adopter 211, data from LCD controller 100 are advantageously shifted into OLED segment driver 210 directly.

Figure 3:
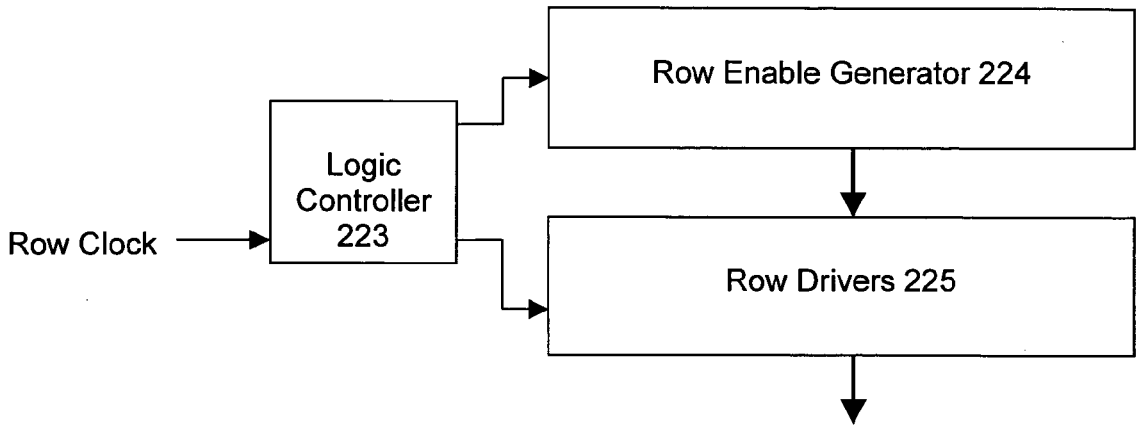
FIG. 3 is a block diagram of an interface adopter for the OLED common driver according to another embodiment of the present invention.

FIG. 3 is a block diagram illustrating common interface adopter 221 processing segment driving signals for OLED common driver 220 according to one embodiment of the present invention. Referring to FIG. 3, common interface adopter 221 further comprises a logic controller 223, row enable signal generator 224 generating signals enabling rows in the pixel matrix of the display system, and a plurality of row drivers 225 driving rows in the pixel matrix. The row clock is shifted in and row enable is active one at a time. A row can be active from left to right or from right to left in the pixel matrix. Two or more rows can be active for each row clock to support dual mode display. Since one row output is not connected to another row input, it is relatively simple to change directions and allow dual mode display.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A display system, comprising:

a liquid crystal display (LCD) controller processing general format data and generating segment control signals and common control signals;

an organic light emitting diode (OLED) segment driver;

an organic light emitting diode (OLED) common driver;

a segment interface adopter coupling the OLED segment driver and the LCD controller and processing the segment control signals from the LCD controller for the OLED segment driver; and a common interface adopter coupling the OLED common driver and the LCD controller and processing the common control signals from the LCD controller for the OLED common driver.

2. The system of claim 1 further comprising a drive strength selector controlling drive strength in the OLED segment driver.

3. The system of claim 1 further comprising a drive strength selector controlling drive strength in the OLED common driver.

4. The system of claim 1 wherein the LCD controller is a thin film transistor (TFT) LCD controller.

5. The system of claim 1 wherein the LCD controller is a super twisted nematic (STN) LCD controller.

6. The system of claim 1, the segment interface adopter directly shifting data from the LCD controller to the OLED segment driver.

7. The system of claim 1, the segment interface adopter further comprising a logic controller, gated clock generator, data latch and pulse width modulation (PWM) signal generator.

8. The system of claim 1, the common interface adopter further comprising a logic controller, row enable signal generator and row drivers.

9. An organic light emitting diode (OLED) driver apparatus for a liquid crystal display (LCD) controller processing general format data for display, the OLED driver apparatus comprising:

an OLED segment driver;

an OLED common driver;

a segment interface adopter coupling the OLED segment driver and the LCD controller and processing segment control signals from the LCD controller for the OLED segment driver; and a common interface adopter coupling the OLED common driver and the LCD controller and processing the common control signals from the LCD controller for the OLED common driver.

10. The apparatus of claim 9 further comprising a drive strength selector controlling drive strength in the OLED segment driver.

11. The apparatus of claim 9 further comprising a drive strength selector controlling drive strength in the OLED common driver.

12. The apparatus of claim 9 wherein the LCD controller is a thin film transistor (TFT) LCD controller.

13. The apparatus of claim 9 wherein the LCD controller is a super twisted nematic (STN) LCD controller.

14. The apparatus of claim 9, the segment interface adopter directly shifting data from the LCD controller to the OLED segment driver.

15. The apparatus of claim 9, the segment interface adopter further comprising a logic controller, gated clock generator, data latch and pulse width modulation (PWM) signal generator.

16. The apparatus of claim 9, the common interface adopter further comprising a logic controller, row enable signal generator and row drivers.

17. A method for driving an organic light emitting diode (OLED) for a liquid crystal display (LCD) controller, comprising:

processing general format data for display in the LCD controller;

providing segment control signals and common control signals from the LCD controller;

processing the segment control signals in a segment interface adopter;

processing the common control signals in a common interface adopter;

driving the segment control signals in an OLED segment driver; and driving the common control signals in an OLED common driver.

18. The method of claim 17 further comprising controlling drive strength in the OLED segment driver.

19. The method of claim 17 further comprising controlling drive strength in the OLED common driver.

20. The method of claim 17 further comprising directly shifting data from the LCD controller to the OLED segment driver.

* * * * *